United States Patent [19]

Sarda

[11] Patent Number: 4,960,048

[45] Date of Patent: Oct. 2, 1990

[54] MULTI-COLOR VARIABLE FORMAT OFFSET PRINTING PRESS

[76] Inventor: Jean L. Sarda, 48, Avenue Claude Vellefaux, Paris, France, 75010

[21] Appl. No.: 376,242

[22] Filed: Jul. 6, 1989

[30] Foreign Application Priority Data

Jul. 7, 1988 [FR] France ..... 88 09243

[51] Int. Cl.[5] ..... B41F 5/16

[52] U.S. Cl. ..... 101/182; 101/247; 101/184

[58] Field of Search ..... 101/174, 177, 178, 179, 101/180, 181, 182, 183, 184, 185, 138, 139, 143, 144, 145, 221, 247

[56] References Cited

U.S. PATENT DOCUMENTS

| | | | |
|---|---|---|---|
| 2,967,475 | 1/1961 | Ritzerfeza et al. | 101/144 |
| 3,072,050 | 1/1963 | Wolff | 101/182 |
| 3,196,786 | 7/1965 | Hornberger et al. | 101/247 |
| 3,424,084 | 1/1969 | Chambon | 101/182 |
| 3,869,983 | 3/1975 | Garber et al. | 101/182 |
| 4,240,346 | 12/1980 | Lawns et al. | 101/139 |
| 4,250,809 | 2/1981 | Pullen | 101/177 |
| 4,280,406 | 7/1981 | Corse | 101/177 |
| 4,369,705 | 1/1983 | Gelinns | 101/177 |
| 4,442,773 | 4/1984 | Kobayashi | 101/177 |
| 4,462,311 | 7/1984 | Armeun | 101/143 |
| 4,526,099 | 7/1985 | Niemiru et al. | 101/182 |
| 4,756,245 | 7/1988 | Roch | 101/247 |
| 4,831,926 | 5/1989 | Bowman et al. | 101/138 |
| 4,833,982 | 5/1989 | Liebert et al. | 101/177 |

*Primary Examiner*—Eugene H. Eickholt
*Attorney, Agent, or Firm*—James E. Bradley

[57] ABSTRACT

Multi-color offset printing presses for variable formats for continuous web printing with or without 'Caroll' type perforations. This pressure exerted on the blanket bearing cylinder is released at the end of format and at least one printing cycle out of two by the action of a hydraulic cylinder. This enables the continuous web to be positioned correctly before the following printing cycle.

5 Claims, 15 Drawing Sheets

MULTI-COLOR VARIABLE FORMAT OFFSET PRINTING PRESS

BACKGROUND OF THE INVENTION

1. Field of the Invention

The present invention relates to multi-color offset printing presses, for variable formats, intended for printing on continuous webs from rollers or fan-folded sheets and perforated such as 'Caroll' types.

2. Description of the Prior Art

At the present, continuous printing is carried out on very large printing units which are well adapted with high rates for heavy runs. However, the setting up is long and out of proportion for short or medium runs. As well as this, the rapid development of microcomputing and falling production costs mean that many medium-sized companies are becoming computerized. This has created a new demand for short and medium runs of continuous printing. Traditional printers, equipped mainly with sheet-fed presses, cannot respond.

Producers of offset presses, aware of this new market, are beginning to produce, in relatively small numbers, equipment which is more appropriate to this demand. However, their lack of versatility added to the fact that their prices, compared to similar sheet-fed equipment, are about three times as much, make it difficult to absorb their cost at the present stage of development of this new procedure. On top of this, these presses are only designed for the printing of forms or labels for computer use. These presses cannot deal with continuous web printing where there are no 'Caroll' perforations. Their traction systems for the web and their margin guide are related to the holes of these perforations.

Now in the field of printing from an unperforated web for short or medium runs, such as labels for example, there exists a massive market which is totally beyond the reach of the traditional printer who only has sheet-fed offset presses.

As well as this, these small presses may have only a mono-color passage through the machine. Sometimes they are able to deal with only one color at each passage through the machine. They may also be equipped with a complementary inking head allowing for an extra color during the same passage. This extra color, which is obtained on the same blanket as that which equips the main printing unit of the press, does not guarantee a superimposition of colors. There is a risk of the inks running together after a short run, even by using inks of a different viscosity and taking all sorts of precautions.

For a professional printer, these complementary inking heads leave their particular color on a single blanket which is inked with another color by the inking unit of the press. They are very useful for printing which does not require a perfect juxtaposition of colors. It happens that at the moment the majority of continuous printing requires at least two or three colors of which some are superimposed. This necessitates the use of a blanket per color to be sure of obtaining, without problems, a perfect job.

These problems are the same for continuous printers who don't have either one or several color presses enabling them to change the format, at will and in a few minutes, depending on the different types of successive printing materials to be dealt with. Professional continuous printers at present are equipped with multi-color presses where each printing unit has its own printing blanket, thus avoiding the risk of different colored inks running together. The rates of these presses are in the order of 30,000 to 50,000 copies per hour.

A prior art press is shown in FIG. 1. A roll of paper feeds the press 2 with a web of paper 3 which goes successively through an automatic lateral guiding device 4, then between the blanket bearing cylinders 5 and the pressure cylinders 6 of the different printing units 7. Having been printed, the paper web 3 is then drawn by a rotary press 8 and rerolled with the help of the roll holder 9 or treated with the help of established devices. These devices are adaptable depending on their use and enable, for example, 'Caroll' type perforations to be obtained, then longitudinal and transversal perforations and then fan-folding. Depending on the presses and the end product, cutting devices are attached at the exit of the press to change the web into sheets. These machines are very efficient for long runs but in the case of short or medium runs (of the order of 1000 to 20,000 copes) which succeed each other with variable formats, they are inadequate. They require too much precise setting time, usually requiring several hours in the case of a change of format. They have only a limited number of formats.

This comes mainly from their operating principle. In effect, these presses work continuously without stopping between each printing cycle. The circumference of the blanket-bearing printing cylinders 5, the pressure cylinders 6 and the plate-bearing cylinders 10 determine the duration of the printing and therefore the format. This means that for each change of printed material which isn't of the same format or could be divided from it, it is necessary to change the cylinders and the sets of gears controlling them. The printer is obliged to possess and change on each press a certain number of cylinders of variable diameters. In any case because of this requirement, the printer is very limited by the formats of the printed materials he can offer to his clients.

The designers of continuous printing presses, aware of this problem, tend to propose to the users continuous presses with variable formats. In the prior art type of FIG. 1, the printing units 7 are interchangeable, which saves some of the time. There nevertheless is still too much time required between each setting occasioned by a change of format. This solution is costly and limiting for the printer. This solution is reflected in the price of the printed material and is only a palliative which seriously limits the number of possible formats.

Recently a three-color continuous press, with a variable format, and only dealing with 'Caroll' fan-folded form webs, has brought the beginning of a solution to this problem. However, it has, amongst others, two serious drawbacks. The three colors are obtained from a single blanket. It has only been designed to deal with forms from 'Caroll' webs. As well as this, the basic design means that it is not possible to build units which can be distributed widely at a low price.

SUMMARY OF THE INVENTION

This invention takes into account the inadequacies of techniques at the present time. It allows for a range of multi-color and multi-purpose offset presses, largely variable in format, to be dealt with by changing movable feed and reception modules within only a few minutes. It enables both printed material on rolls or in 'Caroll' webs.

In one form of the invention the presses have a printing and general operating mode which is similar to that of the one or several color 'continuous' type offset presses. They also use for superimposing the colors, one blanket per color. Like the continuous presses and depending on their use, the presses based on the invention may or may not keep the same basic functions to which those brought by the invention are added.

The mode of feeding from a roll as well as the devices for guiding and lateral positioning of the web are practically the same. They can also use all the accessories generally used with this type of press such as, for example, those used for 'Caroll' fan-folding from the printed web or cutting devices. The printing units can be the same, enabling for example, simultaneous recto-verso 'blanket against blanket'.

In another form of the invention, the presses have a printing and general operating mode which is similar to the multi-color offset presses of 'sheet by sheet' type. They can also, as in the first form of the invention, depending on their use, if required, keep their basic functions to which are added those brought by the invention.

In the invention, the pressure exerted between the blanket bearing and pressure cylinders, and the paper web driving device is released and reapplied during the printing cycle, in order to obtain printed material of any format within the printing limits of the press. This releasing and applying of pressure is adjustable over the 360 degrees of the cylinders' circumference. The web of paper is repositioned during the time when the pressure is released before the subsequent printing. Guiding devices position the web laterally. The same guiding devices and rotary presses work in combination with each other for controlling the release and application of pressure. An electronic device ensures, depending on the format, the register of the web, with or without 'Caroll' perforations.

In a preferred mode of the invention and in its first form for 'continuous' type presses, the printing is obtained one printing cycle out of two. The pressure is released at the end of the format after printing. The paper web is not taken up because of the release of pressure. The paper web is repositioned. Lighter printing units can be used which are therefore much less costly. In this set-up the plate bearing cylinder is inked twice on each printing.

Based on this conception and depending on the different possible versions with the aim of lower production costs, the printing unit may preferably be built from a basic set-up which enables all or part of the elements necessary for the different versions to be incorporated. This printing unit is made up of a small movable unit which adds an extra color on a single blanket. This small complementary unit also has the advantage for each printing cycle of having two inking cycles. Because of this, it can be much lighter in comparison to a normal unit.

These presses can, for bigger runs and with the same elements, work purely in the continuous mode. In this case they are equipped with printing units for which the diameter of the printing cylinders corresponds to that of the format being dealt with or one which can be divided from the latter.

These presses can also deal with printed material in 'alternative continuous'. This printing is mainly used with 'Caroll' continuous web forms and enables a form to be printed, then a given number which are not printed. The forms which are not printed are printed with different printed material from the others, in their turn, in successive passages through the machine.

In the second form of the invention, the result obtained is broadly the same as far as continuous multi-colored printing with largely variable formats is concerned. However, the presses cannot because of their design, which uses a cylinder 'gap', print purely in the continuous mode. On the other hand they can be usefully sheet-fed or fed by continuous web for rolls or from 'fan-folded' with 'Caroll' holes.

The different feed and reception modules of these sheet-fed or continuous presses are preferably movable and interchangeable with those used on continuous presses. All the means employed for producing the invention can also be used with existing presses to render them multi-purpose.

Without going beyond the framework of the present invention, mono-color presses of the continuous or 'sheet' type can be linked mechanically and use all the means which are the features of the invention. Purely as an example and with reference to the attached drawings, a variety of set-ups and possibilities offered by the presses are described for the purpose of illustrating the invention.

BRIEF DESCRIPTION OF THE DRAWINGS

FIG. 12 represents schematically the sheet-fed press of FIG. 10 equipped with two supply 13 and reception 14 modules enabling continuous printed material with variable formats from 'Caroll' perforated webs to be dealt with.

DETAILED DESCRIPTION OF THE INVENTION

Figure 1:
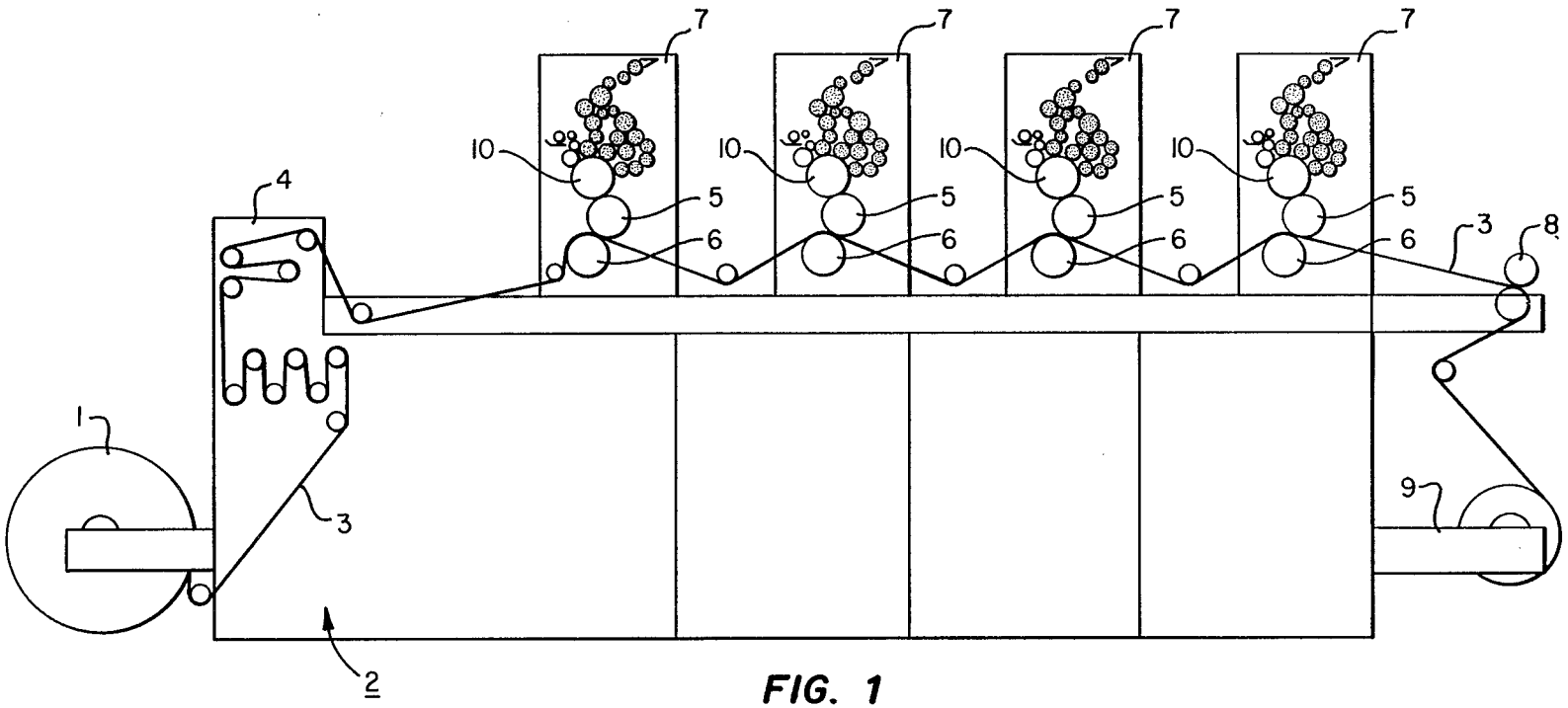
FIG. 1 (Prior Art)
FIG. 1 is a schematic sectional view of a prior art printing press.
Figure 2:
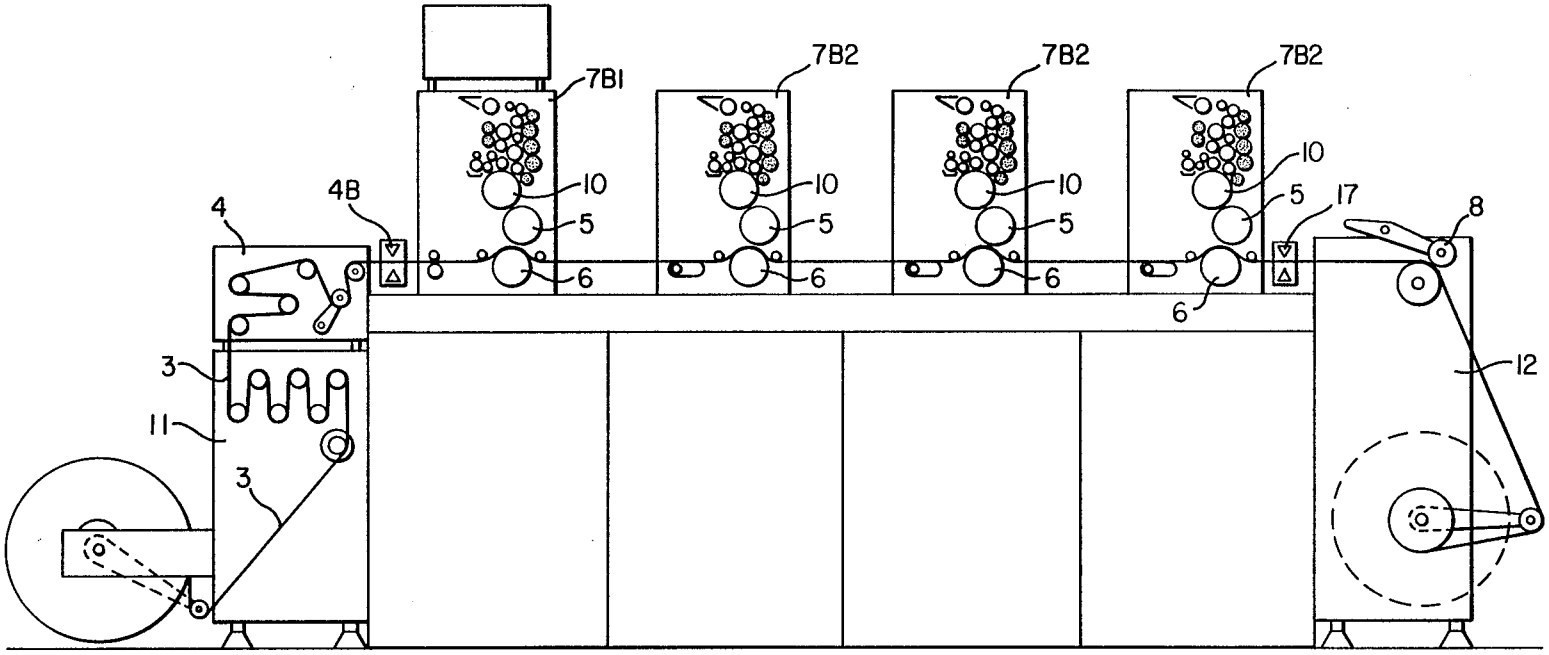
FIG. 2 is a schematic sectional view of a press constructed in accordance with this invention and capable of operating purely continuously or continuously with varying formats.
Figure 7A:
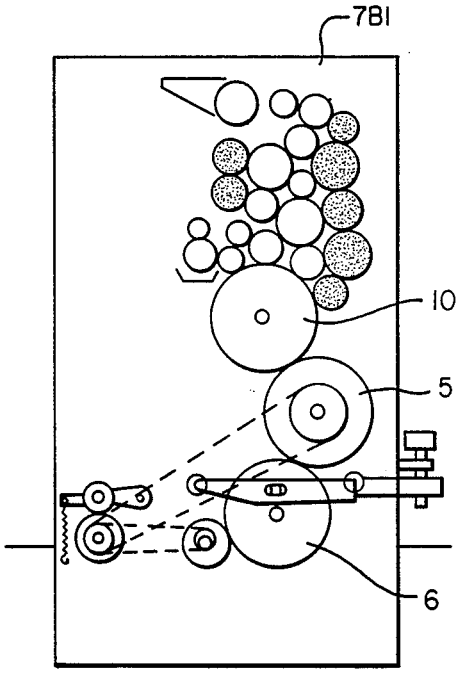
FIGS. 7A and 7B are schematic sectional views of the printing units 7B1 and 7B2 of the printing press of FIG. 2.
Figure 7B:
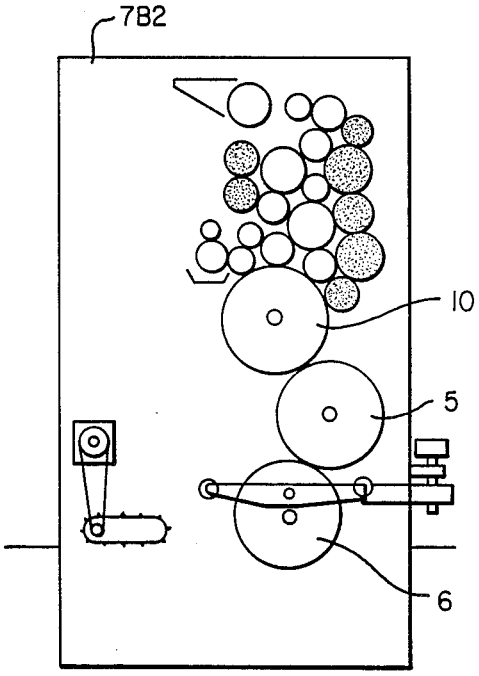
Figure 8A:
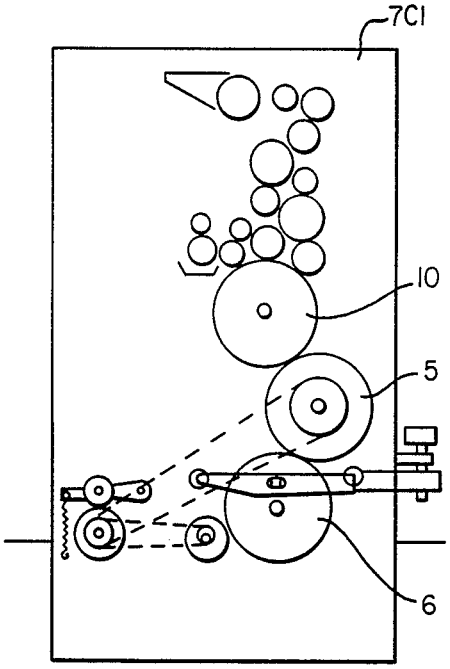
FIGS. 8A and 8B are schematic sectional views of the printing units 7C1 and 7C2 of the printing press of FIG. 3.
Figure 8B:
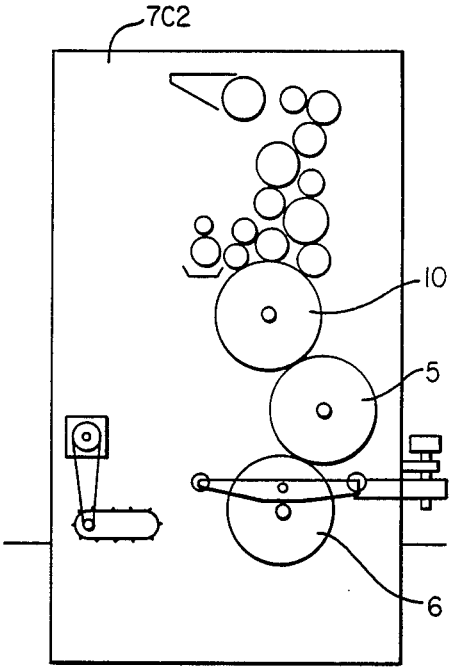

Elements in the drawings which are in common with the prior art press of FIG. 1 are indicated with the same numerals and may not always be discussed. Referring to FIG. 2, the press is equipped with an interchangeable supply module and a guiding device 4 and a reception device 12. It is made up of printing units 7B1 and 7B2, which are shown more in detail in FIG. 7. These units enable purely 'continuous' printing to be carried out. In continuous printing, there is one inking of the printing plate for each printing cycle. Variable formats may be used by substituting units 7C1 and 7C2, FIG. 8, or units 7D1 and 7D2 FIG. 9.

Figure 3:
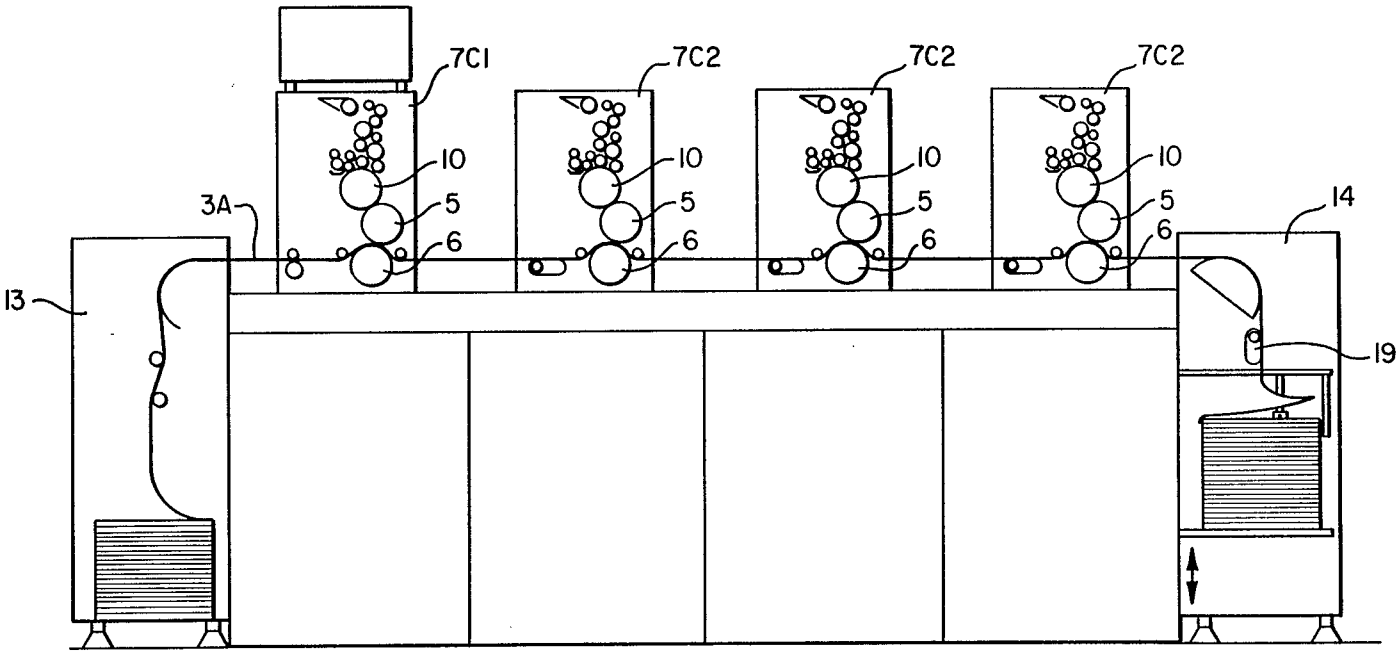
FIG. 3 is a schematic sectional view of the press of FIG. 2, shown working continuously with mainly variable formats.
Figure 6A:
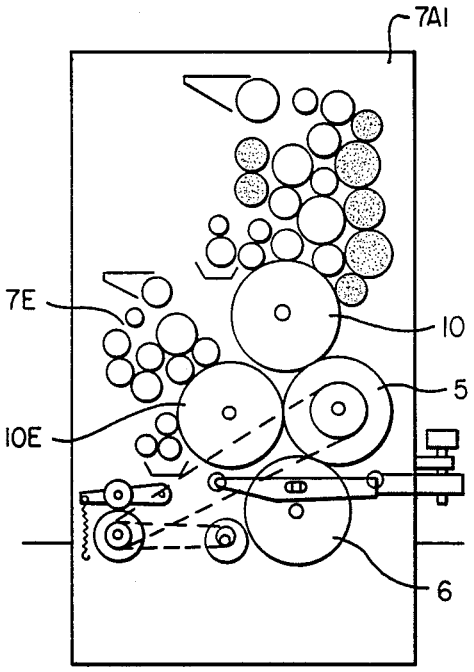
FIGS. 6A and 6B are schematic sectional views of printing units which may be used in place of the printing units 7D1 and 7D2 of FIG. 4.
Figure 6B:
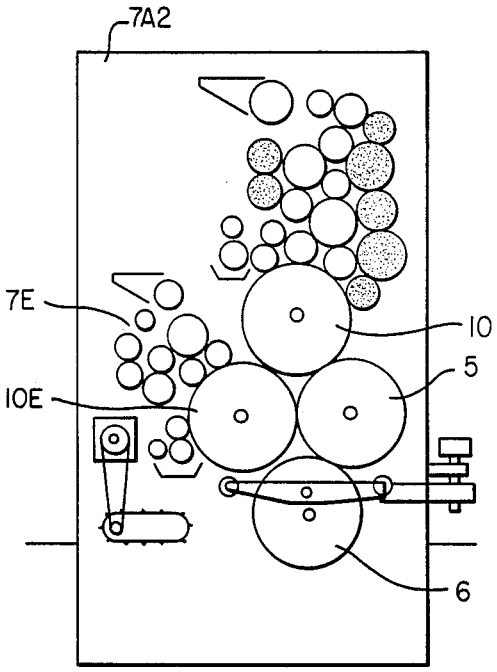

FIG. 3 represents schematically this same press working only 'continuously' with mainly variable formats. There will be one printing for two inking cycles of the printing plate. The press of FIG. 3 is fitted with supply 13 and reception 14 modules designed for dealing with material printed from 'Caroll' webs. It is made up of printing units 7C1 and 7C2 which are shown in more detail in FIG. 8. Units 7C1 and 7C2 are lightened. The crushing cylinders, the distribution and ink form rollers, all shown in black in FIGS. 6 and 7, have not been fitted. This printing unit inks the plate 10 twice per printing and gives an excellent inking quality.

Figure 4:
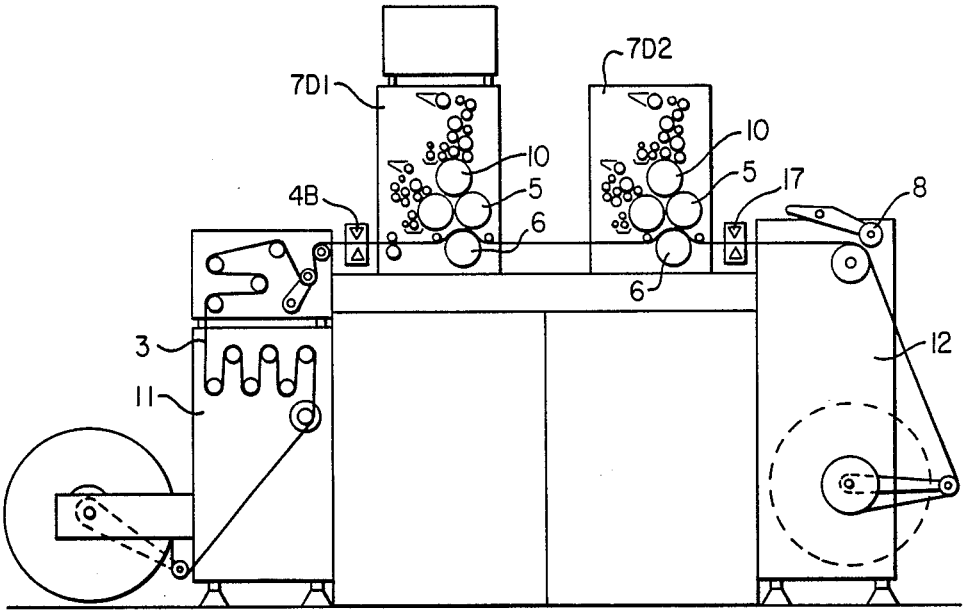
FIG. 4 represents schematically a press made up of two printing units 7D1 and 7D2, FIG. 9, fitted with a small unit for an extra color 7E for continuous working with mainly variable formats.
Figure 9A:
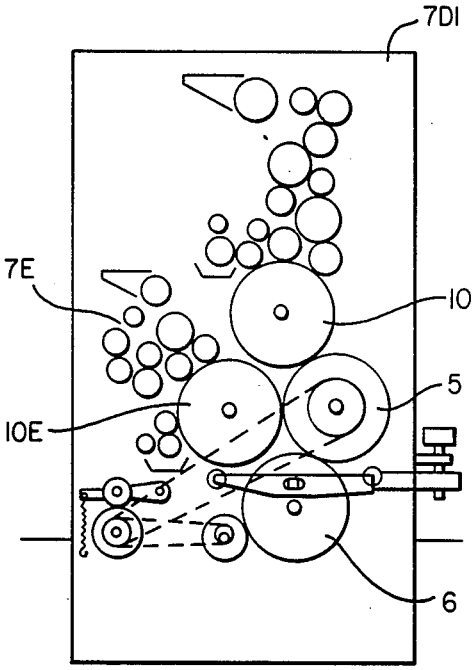
FIGS. 9A and 9B are schematic sectional views of the printing units 7D1 and 7D2 of FIG. 4, and are the same as the units 7A1 and 7A2 of FIGS. 6A and 6B, except for the deletion of crushing cylinders, distribution and ink form rollers, shown in black in FIGS. 6A and 6B.
Figure 9B:
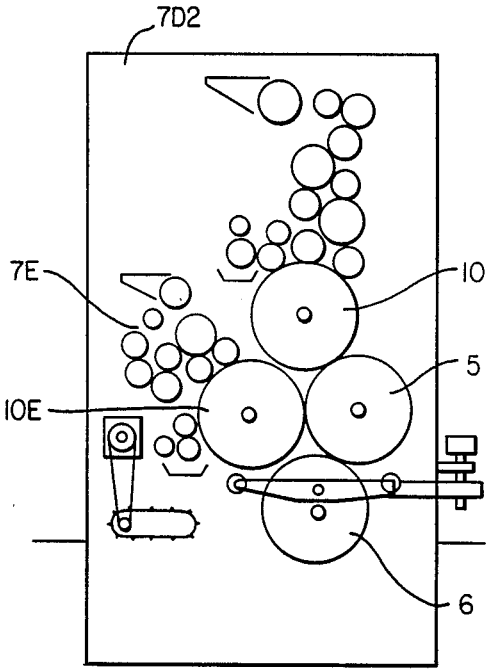

FIG. 4 represents schematically a press made up of two printing units 7D1 and 7D2, FIG. 9, fitted with a small unit for an extra color 7E for continuous working with mainly variable formats. The press of FIG. 4 has a small unit 7E (FIG. 9) for extra color. The press can also be equipped with the printing units 7A1 and 7A2, FIG. 6, or 7B1 and 7B2, FIG. 7, for use also in pure 'continuous' printing. The supply 11 and reception modules 12 complete this assembly.

Figure 5:
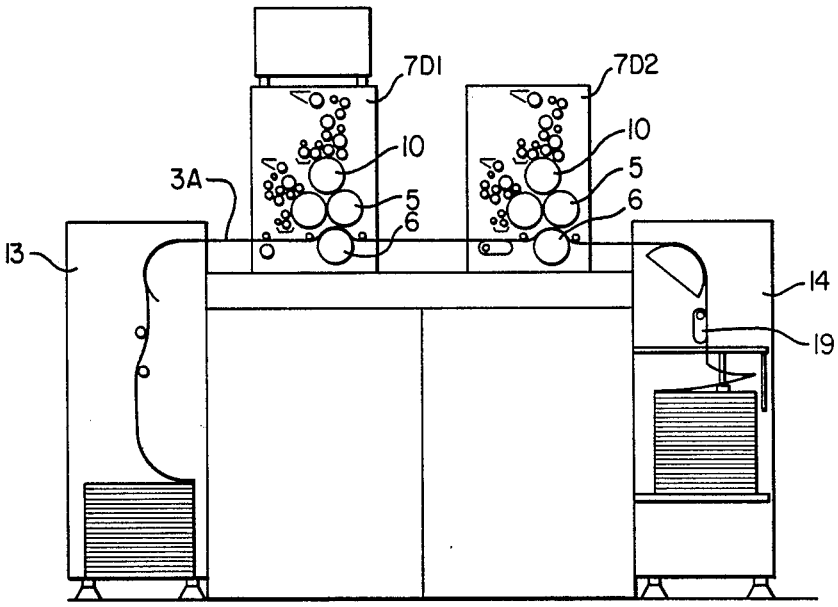
FIG. 5 represents schematically a 'continuous' press for mainly variable formats, made up of two printing units 7D1 and 7D2, FIG. 9, equipped with supply 13 and reception 14 modules to deal with 'Caroll' perforated webs.

16 FIG. 5 represents schematically a 'continuous' press for mainly variable formats, made up of two printing units 7D1 and 7D2, FIG. 9, equipped with supply 13 and reception 14 modules to deal with 'Caroll' perforated webs. FIGS. 6, 7, 8 and 9 represent schematically, in their different versions, the printing unit which equips these 'continuous' presses.

Figure 10:
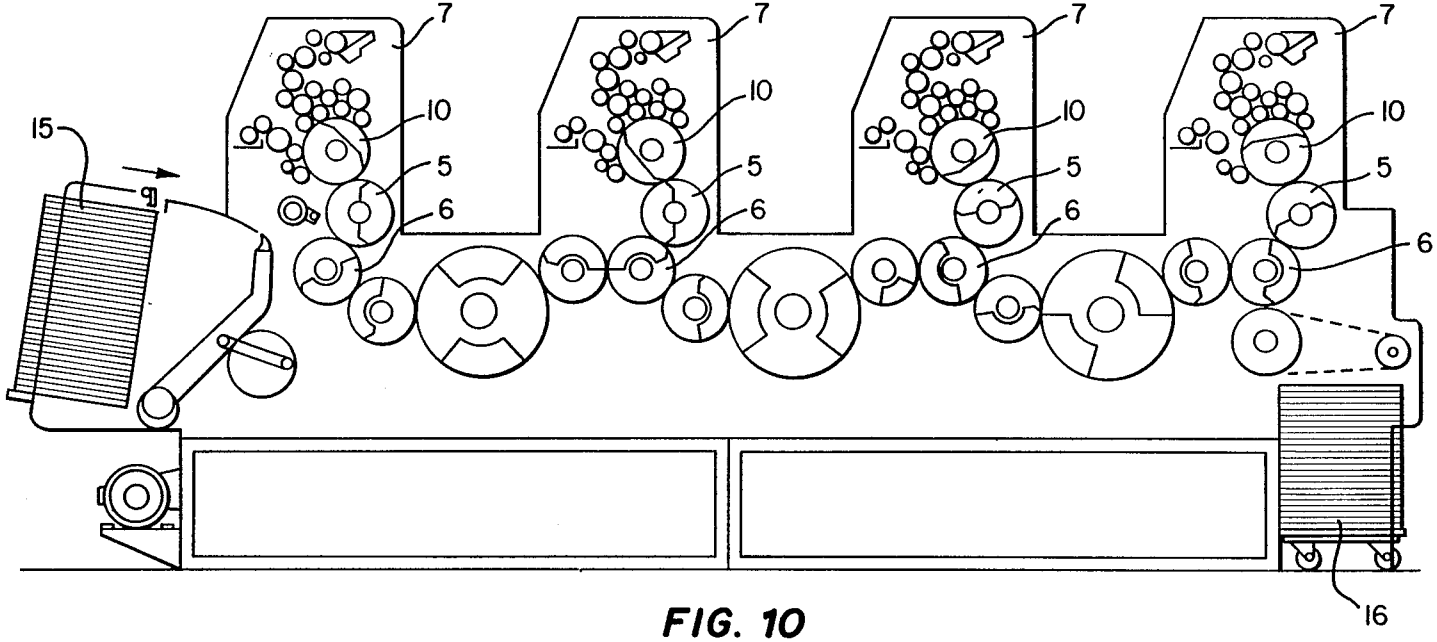
FIG. 10 represents schematically a conventional four color sheet-fed press, equipped with a sheet feed 15 and reception 16.

FIG. 10 represents schematically a conventional four color sheet-fed press, equipped with a sheet feed 15 and reception 16. It should be noted that all the blanket-bearing 5, pressure 6, and plate bearing 10 cylinders are of a larger diameter (about 180 millimeters instead of 120 millimeters) than that of the continuous presses of FIG. 1. Also, these cylinders incorporate 'gaps' called cylinder 'gaps' to enable the pressure cylinders 6 to be fitted with pick-up grippers for the sheet which is to be printed. In this version of the invention, the web is positioned, drawn through and guided with the help of the same means as those described in detail below concerning the 'continuous' type presses. The pressure of the blanket bearing cylinder 5 is also released at the end of the format.

Figure 11:
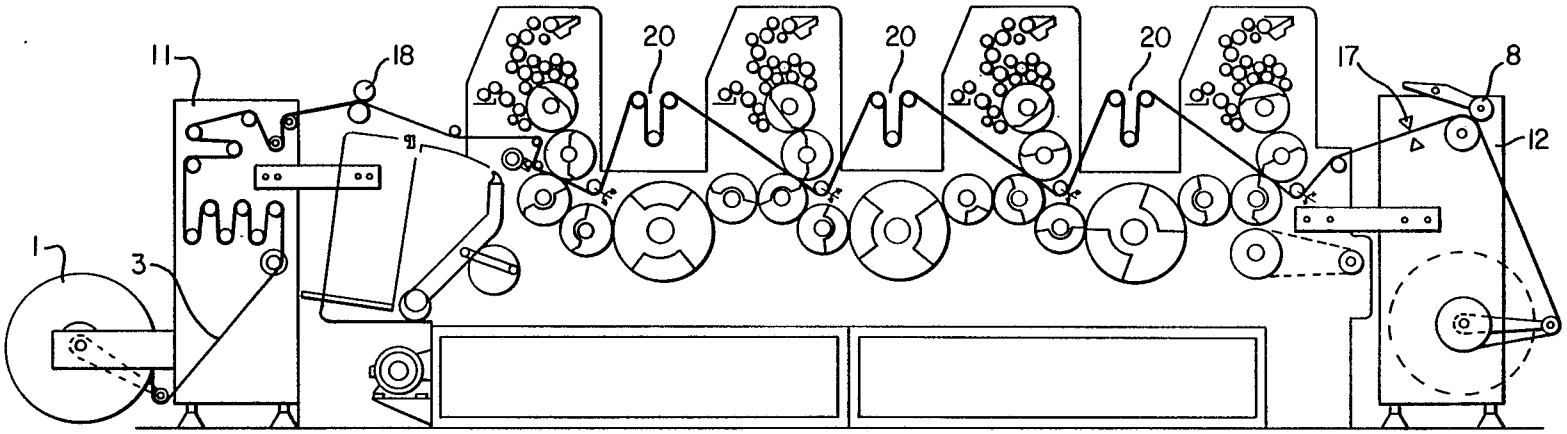
FIG. 11 represents schematically the sheet-fed press of FIG. 10 equipped with two supply 11 and reception 12 modules enabling continuous printed material variable in format to be dealt with from paper webs off the roll 1.

FIG. 11 represents schematically the sheet-fed press of FIG. 10 equipped with two supply 11 and reception 12 modules enabling continuous printed material variable in format to be dealt with from paper webs 3 off the roll 1. A tension buckle 20 enables the register and the format to be adjusted between each printing unit. A remargin drum 18 draws the web 3 backwards between each printing cycle. A detector 17 gives a signal to the electronic control.

Figure 12:
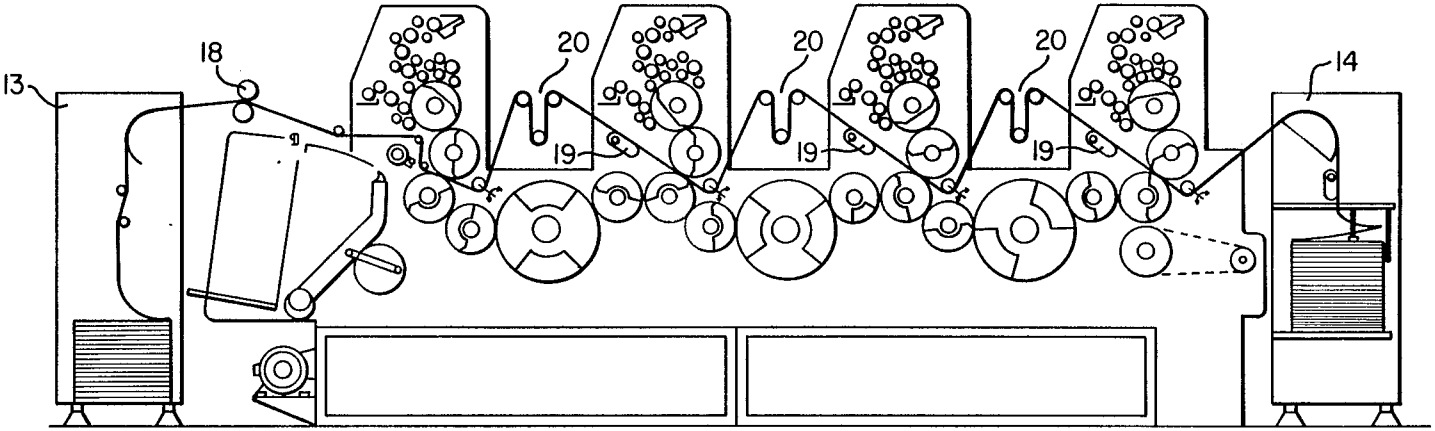

FIG. 12 represents schematically the sheet-fed press of FIG. 10 equipped with two supply 13 and reception 14 modules enabling continuous printed material with variable formats from 'Caroll' perforated webs to be dealt with. All the same elements such as the remargin drum 18, the pin tractors 19, the tension buckle 20, the feed modules 13 and 11, and reception module 14 and 12, equip this press in the same manner as those of the 'continuous' type.

It is obvious that numerous combinations are possible. For example, the version illustrated in FIG. 3, in relation to a continuous press with variable formats, can be slightly modified to deal as well with this same printed material in a purely continuous manner by using broadly the same means as those indicated in FIG. 2.

FIGS. 13–18 show an example of a continuous printing press with variable formats. This press is made up of an assembly of printing modules 2A and 2B which are additional depending on the number of inking heads which are necessary. The association of the supply module 13 and the reception module 14 enable the fan-folded web 3A with 'Caroll' perforations to be dealt with. A rapid change by the supply module 11, FIG. 14, and reception module 12 easily transforms the press and enables the web 3 which arrives on a roll to be dealt with. The printing units 7C1 and 7C2, FIG. 13, have adjustable positions on their modules so that the length of web to be printed between each pressure cylinder 6 corresponds to a whole number of formats so as to obtain the register.

Figure 15:
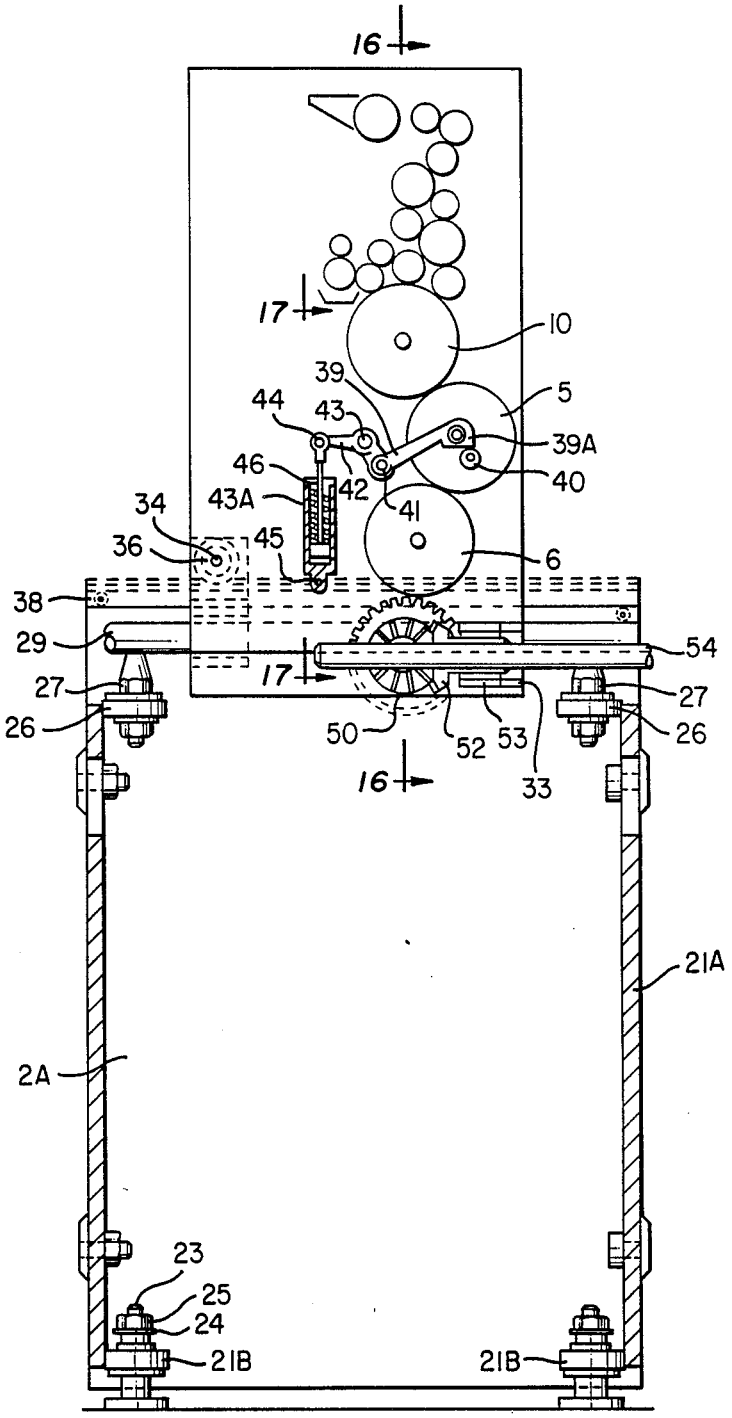
FIG. 15 is an enlarged vertical sectional view of the printing unit 2A of the printing press of FIG. 14.
Figure 16:
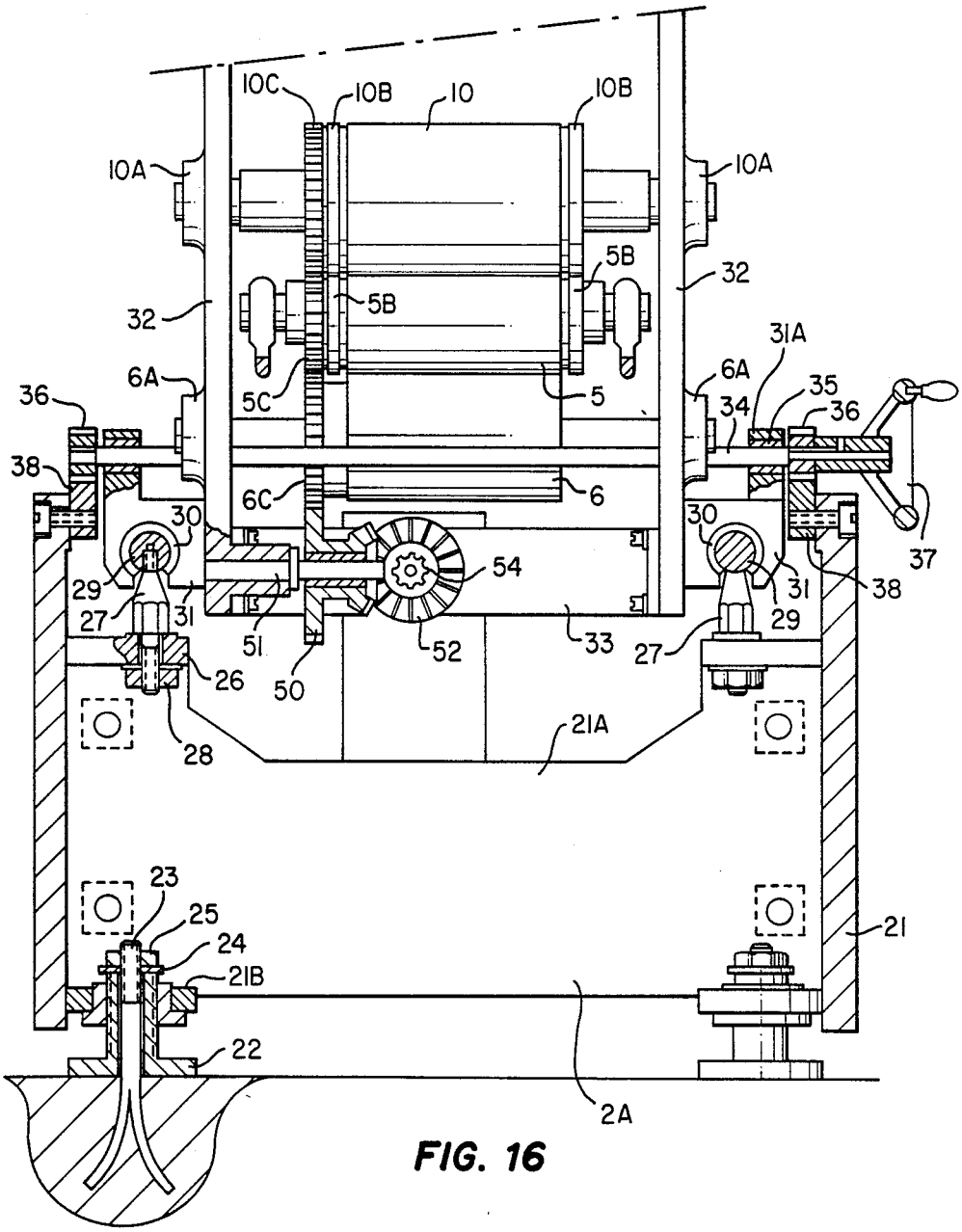
FIG. 16 is a partial vertical sectional view of the printing unit of FIG. 15, taken along the line 16—16 of FIG. 15 and with the inking roller assembly removed.
Figure 17:
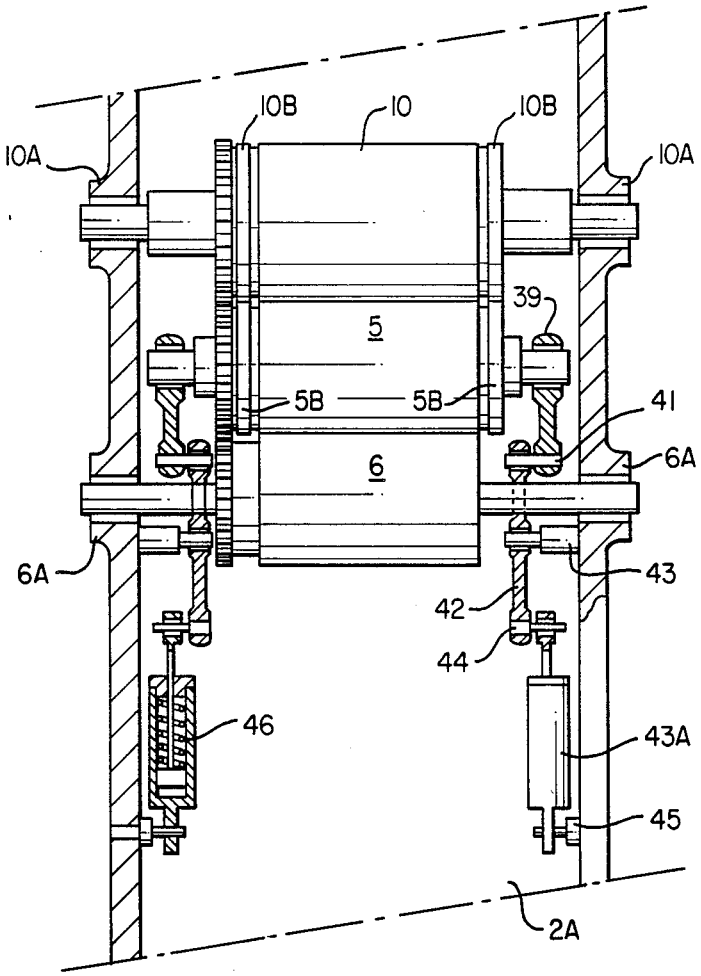
FIG. 17 is a vertical sectional view of the printing unit of FIG. 15, taken along the line 17—17 of FIG. 15, and also showing connected rods 39 and levers 42 in section.

A preferred means for the printing modules 2A is shown in FIGS. 15, 16 and 17. A frame 21, FIG. 16, is made either by mechanical welding, or in a smelting works either from casting steel or casting aluminum. Brackets 21B incorporate devices for positioning on the ground which are adjustable in height so that the levelling of the machine can be obtained correctly.

Threaded feet 22 which screw or unscrew depending on the height required are held firmly in place by fixation rods 23 together with washers 24 and nuts 25. Supports 26 on which the stanchions 27 are fixed and blocked by the nuts 28 are held in the angles of the frame 21 and spacers 21A. The stanchions 27 are screwed into guiding bars 29 on which slide split rings 30 mounted on the bearings 31 for supporting flanges 32 of the printing module. The flanges 32 in which the plate bearing cylinder 10 and the pressure cylinder 6 rotate are assembled by a set of spacers, of which only the spacer 33 is shown for easy understanding of the drawing.

A crossing shaft 34 turns in the rings 35 set in the bosses 31A on two of the bearings 31. A set of gear 36 and a crank wheel 37 are keyed on this shaft 34. The movement of the crank wheel 37 causes the rotation of the gears 36. The gears 37 engage racks 38 fixed on the frame 21, to ensure the movement and the positioning of the whole of the printing module. A plate bearing cylinder 10 and a pressure cylinder 6 rotate in the fixed bearings 10A and 6A. On the other hand the blanket bearing cylinder 5 is pivotable by means of its connection to one end of connecting rods 39, FIG. 17. Each connecting rod 39 has a slide 39A, FIG. 15, bearing against adjustable eccentrics in cam 40.

At the other end of the connecting rods 39, FIG. 17, axles 41 are forced together, pivoting at one of the ends of the elbow levers 42 articulated on the fixed axles 43.

At the other end of the elbow levers 42, single movement hydraulic cylinders 43A are linked. The head of the piston rod, which rotates on the axles 44 and the body of the hydraulic cylinders 43A on the fixed axles 45. The cylinders 43A, being single movement ones, return after the releasing of the pressure on the hydraulic circuit is ensured by springs 46.

Figure 13:
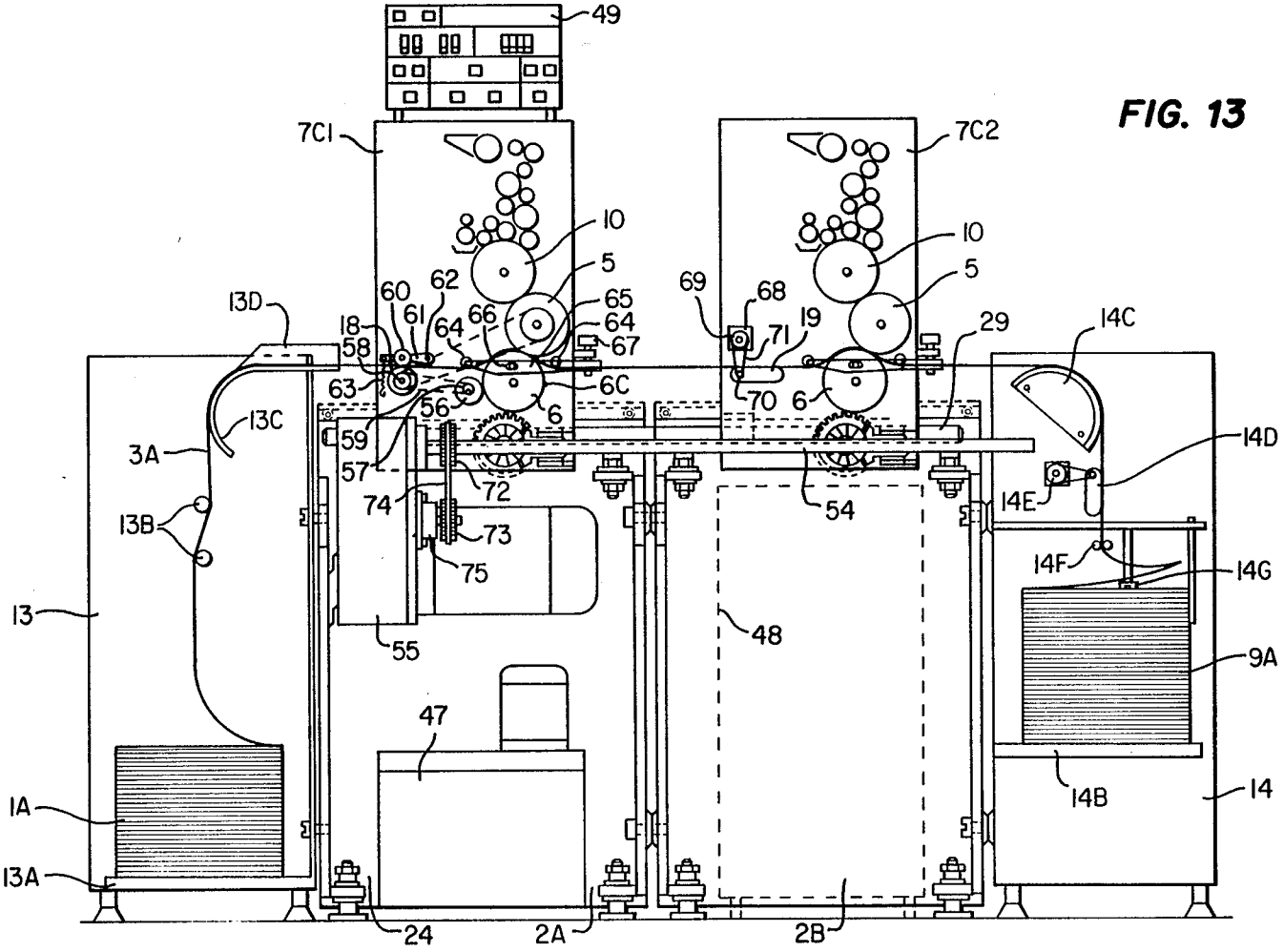
FIG. 13 is a cross sectional view of a continuous printing press capable of printing variable formats constructed in accordance with this invention.

The control of the cylinders 43A is carried out by a conventional hydraulic source 47, FIG. 13, which is made up of a pump, an accumulator, a pressure controller, rate controllers, distribution electrovalves and all the means necessary. For the sake of clarity only the complete unit is shown in the drawing.

The monitoring of this hydraulic source 47 is done from an electronics equipment cabinet 48 linked to a control panel 49 on which are centralised all the adjustment controls which are vital for the correct operating of the printing press. This includes selection of format, printing rate, operating of the dampening and inking units, pressurizing of the blanket bearing cylinder, setting in motion of the printing web and the printing mode selector.

The hydraulic action caused by the cylinders 43A, FIG. 15, linked to the levers 42, connecting rods 39 and eccentrics 40, causes the blanket bearing cylinder 5 to approach the plate bearing cylinder 10 and the pressure cylinder 6. The plate bearing cylinder 10 and the blanket bearing cylinder 5 have tracks 10B and 5B, FIG. 17, commonly called 'cardons', which ensure a functioning which is very precise and fixed between their axes during the printing cycles. In contrast the distance between the axes of blanket bearing cylinders 5, FIG. 15, and the pressure cylinder 6, is obtained due to the juxtaposed actions of the slides 39A, the levers 39 and the adjustable eccentrics 40.

The action of the eccentrics 40, for which the traditional means of adjusting have not been shown for easier understanding of the drawing, brings forward or separates the blanket bearing cylinder 5 from the pressure bearing cylinder 6 due to the thrust of the cylinders 43A. The required variable distance between the axes is thus obtained depending on the thickness of the web to be printed and the pressure to be exerted to obtain a good transfer of the ink placed on the blanket, without there being a shortfall or an excess.

Each printing cylinder has a gear which ensures its rotations. A gear 10C, FIG. 16, of the plate bearing cylinder 10 engages with a gear 5C of the blanket bearing cylinder 5. The gear 5C engages with a gear 6C of the pressure cylinder 6. The gear 6C engages with the cylindrical section of a double gear 50 turning on a fixed shaft 51 fixed on a flange 32 of the mobile printing unit. The conical section of the double gear 50 is drawn into rotation by a conical gear 52 turning in a bearing 53, FIG. 16, fixed on a cross-bar 33. The hub of the conical gear 52 has a grooved bore in which a grooved shaft 54 is set in motion by a moto-reducing unit 55, FIG. 13, which immobilizes it transversely. In this manner each printing unit is carried along, no matter what its position on the guiding bars 29, FIG. 15.

The moto-reducer unit 55, FIG. 13, the hydraulic source 47, and the control panel 49 are incorporated in the basic module 2A. The remargin drum 18 is driven in the opposite direction to the movement of the web 3A by a gear 6C of the pressure cylinder 6 via a gear 56, serrated pulleys 57 and 58 and a serrated belt 59. The pressure rollers 60 slightly pinch the web 3A by means of levers 61 articulated on an axle 62 and by a pressure spring 63.

Rollers 64, turning at the extremities of the lever 65 rotating around the axle 66, enable precise adjustment of the register to be made by moving a micrometric adjusting screw 67. Screw 67 varies the position of the web 3A in relation to the pressure cylinders 6. This movement of the web 3A is local and only effects the two rollers 64 without causing any modification of the register of the other succeeding printing units.

Only the printing unit 7C1 of the base module has in the different versions of the invention, a remargining drum 18 which is used for restretching the 'Caroll' web whether perforated or not. The other printing units are equipped with pin tractors 19 which can drive a paper web perforated with 'Caroll' holes. A stepping motor 68 monitored by an electronics equipment cabinet 48, ensures the rotation of the rotary presses 19 by means of serrated pulleys 69 and 70 and a serrated belt 71.

The description which follows explains the functioning of the whole press, FIG. 13, equipped with modules 13 and 14 which enable continuous fan-folded printing from a web perforated with 'Caroll' holes, to be carried out. The supply module 13 picks up the perforated web 3A from the packet 1A placed on the plate 13A. The extension bars 13B slightly stretch the web 3A which goes over the slide 13C and the guiding slides 13D into the printing modules 7C1. On coming out of the last printing unit 7C2, the web 3A is directed towards the pin tractors 14D of the slide 14C. The step motor 14E ensures the rotation of the pin tractors 14D by the serrated pulley and belt unit. The web 3A is printed and pushed between the lateral guiding bars 14F, onto the stack 9A of folded paper. The web 3A is positioned on the movable plate 14B, the. vertical movement of which is controlled in its downward movement by the level detector 14G. Level detector 14G keeps the top of the pile 9A at a constant distance from the guiding bars 14F, thus ensuring a regular folding of the web 3A.

Once this web is in place, it is essential to position it depending on the fold and in relation to the printing cylinder 6 of the first printing unit 7C1, so as to adjust the register of this first printing. This function is obtained simply by moving the web by acting on the simultaneous manual control of the step motors 68 and 14E of the pin tractors 19 and 14D which are situated on the control panel 49. The movement of the printing unit 7C2 on the guiding bars 29 adjusts the positioning of the fold for the printing by reference of the second color. It should be remembered that there must be a whole number of formats between the two printing units. A slight correction in the register of a unit is obtained by a slight tilting of the levers 65 activated by the adjustment screw 67 without an effect on the margin of the other printing units. This precise adjustment of the margin on each unit is carried out while the machine is working during the printing.

Once the web is in its place, correctly stretched and positioned, it is necessary to display on the control panel 49 the value of the variables corresponding to the work to be carried out. This control panel 49 is linked to the electronics equipment cabinet 48 of established design, the different actions of which are described further below so that a good understanding of the operating of the printing press is possible.

Figure 18:
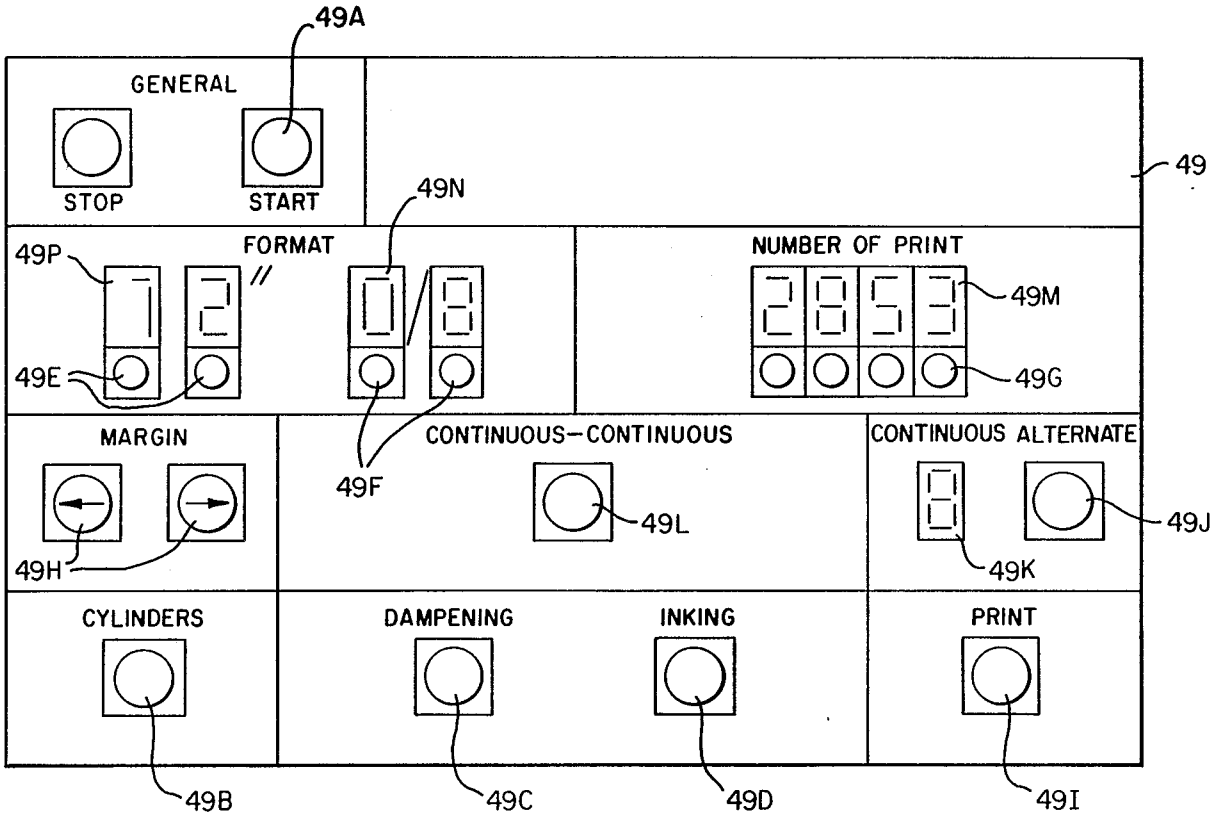
FIG. 18 is a view of the control panel for the printing press of FIG. 13.

By activating the start button 49A, FIG. 18, controlling the overall electric system, the whole of the machine is activated and in particular the control panel 49, FIG. 13, the electrical and electronic equipment cabinet 48, the hydraulic source 47, and the reception module 14 which controls the reduction of the stack 9A. Pressure on a 'Cylinders' button 49B, FIG. 18, activates the moto-reducing unit 55, FIG. 13, which sets off the rotation of all the cylinders of the printing press so as to allow, as a first stage, the preparation of the dampening and inking units, as in all conventional offset printing presses. A 'dampening' button **49*c*, FIG. 18, having been pushed, the clamp form rollers come down onto the plate of the plate bearing cylinder 10, FIG. 13. The ink form rollers do the same if the 'inking' button 49D, FIG. 8**, is in turn pushed. Renewed pressure on these same buttons cancels the previous requested action.

The display of the format for printing in inches on electronic displays 49P is obtained by pushing buttons 49E. The display in fractions of inches, sixths or eighths is obtained on the displays 49N by pressure on the buttons 49F. The number of prints to be obtained is programmed with the help of the buttons 49G and appears on displays 49M. On each printing, a unit will be eliminated and the return to zero will stop the machine at the end of the run required. Pressure on one of the 'margin' buttons 49H moves the web for printing in the direction required, rapidly if the pressure is maintained, step by step if the button is depressed with short impulses, so as to correctly position the print to obtain its register, as explained previously. The machine being ready to print (inking, dampening, perforated web in position), the format displayed as well as the length of the run to be carried out, pressure on the 'Impression' button 49I will set off the printing cycles.

The grooved shaft 54, FIG. 13, which drives all the press' cylinders, allows it, due to the ratio of the gears used, to turn at the same speed as that of the pressure 6, blanket bearing 5 and plate bearing 10 cylinders. The serrated pulley 72, wedged on the grooved shaft 54, drives at the same speed an impulse generator 75 via the serrated pulley 73 and the serrated belt 74. This impulse generator 75 has two tracks. The first track monitors the step motors which drive the pin tractors by pulling on the web at the same linear speed as the circumferential speed of the printing cylinders. The second track only generates a single impulse per rotation, which is used to set off the step motors of the web pin tractors and to activate the hydraulic cylinders 43A, FIG. 15. This moves the blanket bearing cylinder 5 by bringing it to its printing position, bearing against the eccentrics 40 and 'cordon against cordon' with the plate bearing cylinder 10.

The release of pressure at the end of the printing cycle and the stopping of the step motors of the web pin tractors are controlled by the calculator of the electronics equipment cabinet 48, FIG. 13, when the 'format' counters return to zero. Obviously the initial impulse, produced on each rotation by the impulse generator 75 is generated at a very precise position in the printing cycle, in such a way as for there to be a simultaneity between the departure of the web, the putting under pressure and driving by the action of the blanket bearing cylinder 5 against the pressure cylinder 6. It should be noted that the action of the margin drum 18 turning in the opposite direction to the passage of the web stretches the latter permanently without excessive constraint due to the juxtaposed action of the pressure rollers 60 and the springs 63.

The electronic signal of the 'Start', controlling the starting of the step motors and pin tractors 19 and 14D, is adjusted in such a way that the web is drawn forward about half an inch before it is drawn along at the same speed by the printing cylinders. This ensures that the response times, which are different depending on the means used in combination (hydraulic, mechanical and electronic), do not cause a lack of precision, dragging on the holes or untimely breaks in the web. This manner of proceeding neutralizes the inertia of the band when the pin tractors 19 and 14D start and enables it to reach its real speed before being pinched and drawn along by the pressure cylinders. This ensures considerable repetition of the printing register from on printing to the other and therefore a constant register from color to color throughout the run.

In order to obtain a full format printing of the printed material and taking into account the response time of the devices for releasing the pressure of the printing cylinders, as soon as the traction of the web is freed by the press, the pin tractors 19 and 14D are immediately driven backwards about an inch. This moves back and positions the web 3A before the following printing cycle. To do this, the electronic calculator has been programmed to control on the base of a displayed format a forward and backward fraction of an inch. This fractional value of an inch is not absolute and has been determined experimentally. In fact, irrespective of the rate of operating of the press, the release of the pressure is obtained in less than half an inch. The margin drum 18 accompanies the web 3A and moves it backwards, keeping it stretched before the beginning of the following printing cycle. Considering the example of a printing format of 12 inches, the press may be readied to print as follows:

a) display of 12 inches on the control panel 49P;
b) pressure on the button 'Cylinders' 49B which sets in motion all the functions of the press;
c) pressure on the button 'Print' 49I which permits the printing cycle;
d) 'Start' impulse of the impulse generator 75, FIG. 11.

This starts the beginning of the traction of the web 3A with the help of the pin tractors 19 and 14D, the total movement of which will be of twelve plus one inches, that is 13 inches. This starts simultaneously the beginning of the movement of the hydraulic cylinders 43A, FIG. 17. This results in the putting under effective pressure of the printing cylinders. Their slight difference in starting time having allowed the web 3A to pick up its speed by covering about half an inch of its total movement. The effective printing will be on a length of twelve inches. At the end of twelve inches, the format signal ends, which sets in motion the release of pressure of the cylinders. During the release from pressure, the web moves forward a maximum of a supplementary half inch. The web 3A, FIG. 13, stops. The web 3A moves backwards an inch by the simple movement of the pin tractors 19 and 14D. The web stops, is positioned and stretched by the margin drum 18 while waiting for the next 'start' of the impulse generator 75. The next 'start' sets the following printing cycle in motion.

Figure 14:
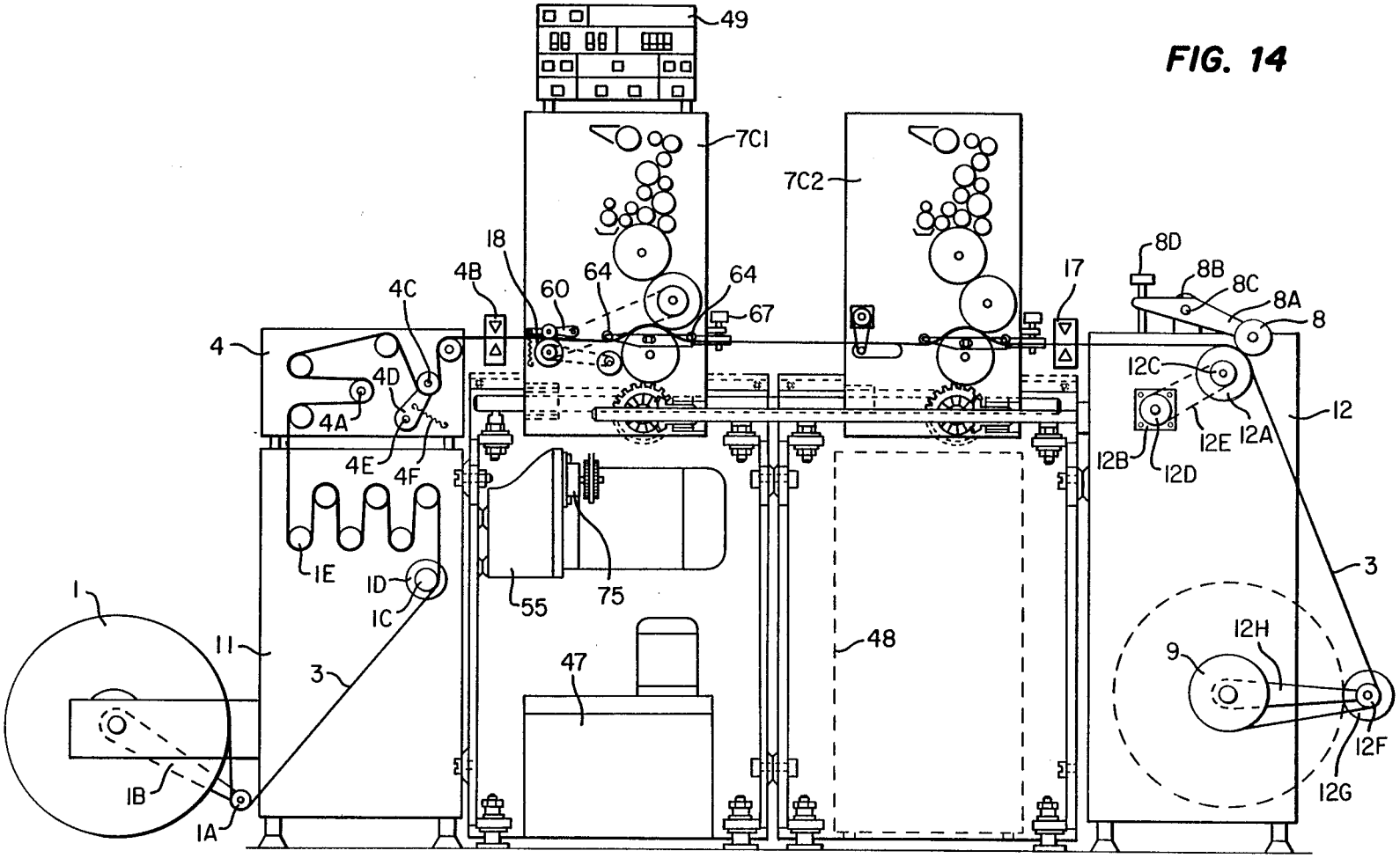
FIG. 14 is a cross sectional view of the printing press of FIG. 13, set up for continuous printing from reel to reel.

FIG. 14 represents the same printing press with variable format in a set-up for continuous printing from reel to reel. The supply module 11 brings the web 3 rolled on the reel 1, the driving of which is ensured by a moto-reducer, not shown here for the clearness of the drawing. The rotation speed is controlled by the control belt and obtained with the roller 1A supported by the levers 1B. The roller 1C has flanges 1D with an adjustable opening depending on the width of the web 3, ensuring pre-alignment before it rolls on to the stretching rollers 1F.

Then the web 3 goes into the guiding module 4, the roller 4A of which being oriented horizontally is linked by the visual detector of the edge of the web 4B and the usual associated means of control, not shown here as they are well-known. At the exit of the last printing unit 7C2, via the remargining drum 18 and its pressure rollers 60, the margin rollers 64 positioned by the adjustment screw 67, the printed web passes in the line reader or detector 17 before going into the winding module 12. The web 3 passes over the traction cylinder 12A driven by the step motor 12B, the serrated pulleys and belt 12C, 12D and 12E. The electronic equipment cabinet 48 and the control panel 49 control this unit, monitored by the impulse generator 75. The pressure rollers 8, fixed at one extremity of the levers 8A pivoting on the bearings 8B by means of the shaft 8C, press very strongly on the web 3 due to the action of the tightening screw 8D, thus ensuring excellent drive.

The printed web 3 treated in this way is wound on the reel 9, which is set in motion by a moto-reducer not shown for the clarity of the drawing but the action of which is known in continuous printing from reel to reel. The rotation speed is controlled by the belt roller 12F equipped with flanges 12G turning on one of the ends of the levers 12H. As in the example explained previously and illustrated by FIG. 14, the web 3 is put in place and the press is prepared for printing. No format is displayed on the control panel 49, FIG. 18. The displays 49M indicate the length of the run to be carried out and the button 'continuous-continuous' 49L has been pressed to replace the end of format signal by the line reader 17, FIG. 14.

After an action on the button 'Print' 49I, FIG. 18, of the control panel 49, the 'start' impulse of the impulse generator 75, FIG. 14, sets off the step motor 12B. The cylinders 43A, FIG. 17, bring the blanket bearing cylinder 5 to bear on the pressure cylinder 6. Simultaneously, the press prints as well as the printed material a reference mark which will be detected as it passes through the detector 17.

As soon as this reference mark is read, a signal is given to the cylinders 43A to release the pressure of the press and to the step motor 12B to stop pulling half an inch further, then to move the web 3 backwards an inch while waiting for the following 'Start' of the impulse generator 75. During the backward movement of the web 3, the margin drum 18 goes with it, keeping it stretched, held on the immobile traction cylinder 12A. The compensating roller 4C turns at one end of the levers 4D articulated on the axis 4E. This pulls the web 3 due to the action of the spring 4F by absorbing the length of the web provided by its backward movement. The unwinding reel 1 continues to turn, the speed of which is controlled by the belt roller 1A. In the same way the winding reel 9 has its speed controlled by the belt roller 12F, which integrates the working and at rest movements of the web 3.

In order to print in the traditional continuous printing mode, it is vital that the diameters of the printing unit cylinders correspond to the format for printing or to a division of this format. Therefore, when this is not the case, the printing units may be arranged corresponding to this format by sliding them on their guiding bars 29, FIG. 15, by engaging them at the end on the disassembled reception module in order to carry out this operation. The web 3 is positioned, as in the reel to reel set-up, FIG. 14, and the press is prepared for printing. No format is displayed on the control panel 49, FIG. 18. The displays 49M indicate the number of copies to be carried out and the 'continuous-continuous' button 49L is pressed.

After pressing on the 'Printing' button 49I, FIG. 18, situated on the control panel 49, the 'Start' impulse of the impulse generator 75, FIG. 14, sets off the step motor 12B and the cylinders 43A, FIG. 17. This brings the blanket bearing cylinder 5 to bear against the pressure cylinder 6. No 'end of format' impulse being given by the electronic equipment, the cylinders are kept under pressure and the step motor pulls the web 3 until the copy counter or step ordered by renewed pressure on the button 49I, FIG. 18, stops the press. It is obvious that the step motors can be replaced by any other sort of motor such as, for example, a continuous current motor linked to an electronic impulse generator.

The detailed operating method of the sheet-fed presses, as well as the means for releasing the pressure at the end of a format by hydraulic cylinders 43A is the sam as those explained and shown in the continuous printing mode.

The invention has significant advantages. It allows for a range of multi-color and multi-purpose offset presses, largely variable in format, to be dealt with by changing movable feed and reception modules within only a few minutes. They may also be used for superimposing the colors, one blanket per color. The mode of feeding from a roll as well as the devices for guiding and lateral positioning of the web are practically the same as prior art presses. They can also use all the accessories generally used with this type of press such as, for example, those used for 'Caroll' fan-folding from the printed web or cutting devices. The printing units can be the same, enabling for example, simultaneous recto-verso 'blanket against blanket'.

In another form of the invention, the presses have a printing and general operating mode which is similar to the multi-color offset presses of 'sheet by sheet' type. With the aim of lower production costs, the printing unit may preferably be built from a basic set-up which enables all or part of the elements necessary for the different versions to be incorporated. This printing unit is made u of a small movable unit which adds an extra color on a single blanket. This small complementary unit also has the advantage for each printing cycle of having two inking cycles. Because of this, it can be much lighter in comparison to a normal unit.

These presses can, for bigger runs and with the same elements, work purely in the continuous mode. In this case they are equipped with printing units for which the diameter of the printing cylinders corresponds to that of the format being dealt with or one which can be divided from the latter.

These presses can also deal with printed material in 'alternative continuous'. This printing is mainly used with 'Caroll' continuous web forms and enables a form to be printed, then a given number which are not printed. The forms which are not printed are printed with different printed material from the others, in their turn, in successive passages through the machine.

In another form of the invention, the result obtained is broadly the same as far as continuous multi-colored printing with largely variable formats is concerned. They can be usefully sheet-fed or fed by continuous web for rolls or from 'fan-folded' with 'Caroll' holes.

The different feed and reception modules of these sheet-fed or continuous presses are preferably movable and interchangeable with those used on continuous presses. All the means employed for producing the invention can also be used with existing presses to render them multi-purpose.

Mono-color presses of the continuous or 'sheet' type can be linked mechanically and use all the means which are the features of the invention.

While the invention has been shown in several of its forms it should be apparent to those skilled in the art that it is not so limited, but is susceptible to various changes without departing from the scope of this invention.

It is also quite clear that in order to illustrate the functioning of the invention, an example of the functioning of these presses has been given using one printing for every two printing cycles and a double inking per printing. In fact, the rotation speeds of the cylinders being relatively slow in relation to those of the 'continuous-continuous' presses, one could, without going beyond the framework of the present invention, carry out, for example, one printing every three printing cycles and three inkings of the printing plate.

I claim:

1. In a multi-color offset printing press for variable formats for a printing continuous web selectively with and without 'Caroll' type perforations, the printing press having a plurality of printing units, the improvement comprising in combination:

a blanket bearing cylinder;

a plate bearing cylinder;

a pressure cylinder;

mounting means for mounting the plate bearing cylinder in rotating contact with the blanket bearing cylinder and the blanket bearing cylinder in rotating contact with the pressure cylinder, with the web being drawn between the pressure cylinder and the blanket bearing cylinder;

means for causing the blanket bearing cylinder to exert pressure against the plate bearing cylinder and the pressure cylinder;

means for releasing the pressure exerted by the blanket bearing cylinder at the end of the format and on at least one printing cycle out of two; and means for driving the web and for stopping forward movement of the web when the pressure is released by the blanket bearing cylinder, to allow the web to be positioned correctly before the following printing cycle.

2. The press according to claim 1 further comprising a hydraulic cylinder connected to the blanket bearing cylinder, and wherein the pressure of the blanket bearing cylinder is released at the end of the format to be printed by the action of the hydraulic cylinder.

3. The press according to claim 1 further comprising a set of guiding bars on which each of the printing units is mounted, and wherein the printing units slide on the guiding bars so as to allow for the adjustment of the register of the web from printing unit to printing unit.

4. The press according to claim 1 wherein the printing units ink the plate bearing cylinder twice for each printing cycle.

5. The press according to claim 1 wherein the printing cylinders have a circumference which corresponds to the format to be dealt with and selectively to a division of this format, to enable them to print in traditional continuous mode.

* * * * *